US011036172B2

(12) United States Patent
Kimura et al.

(10) Patent No.: US 11,036,172 B2
(45) Date of Patent: Jun. 15, 2021

(54) IMAGE FORMING APPARATUS

(71) Applicant: Canon Kabushiki Kaisha, Tokyo (JP)

(72) Inventors: Toshinori Kimura, Tsukuba (JP); Teruhiko Suzuki, Tokyo (JP); Naoki Ishikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/070,004

(22) Filed: Oct. 14, 2020

(65) Prior Publication Data

US 2021/0109472 A1 Apr. 15, 2021

(30) Foreign Application Priority Data

Oct. 15, 2019 (JP) ..... JP2019-188406

(51) Int. Cl.
*G03G 15/20* (2006.01)
*G03G 15/00* (2006.01)

(52) U.S. Cl.
CPC ..... *G03G 15/55* (2013.01); *G03G 15/2039* (2013.01); *G03G 15/5004* (2013.01)

(58) Field of Classification Search
CPC . G03G 15/55; G03G 15/2039; G03G 15/5004
See application file for complete search history.

(56) References Cited

U.S. PATENT DOCUMENTS

2007/0116487 A1* 5/2007 Takahashi ..... G03G 15/80 399/88
2018/0335821 A1* 11/2018 Kamiya ..... G03G 15/5004

FOREIGN PATENT DOCUMENTS

JP 2008026175 A 2/2008

* cited by examiner

*Primary Examiner* — Clayton E. LaBalle
*Assistant Examiner* — Michael A Harrison
(74) *Attorney, Agent, or Firm* — Venable LLP

(57) ABSTRACT

An image forming apparatus includes: an image forming device; a fixing device including a fixing unit configured to fix a toner image to a recording sheet; a first AC receiving portion configured to receive power for the image forming device from an AC power source; a second AC receiving portion configured to receive power for the fixing device from the AC power source; a third AC receiving portion, which is removably connected to the image forming device, and is configured to receive power to be supplied to the fixing unit via the first AC receiving portion; and a connection detecting portion configured to detect whether power is supplied from the third AC receiving portion to the fixing device. The image forming device detects whether the third AC receiving portion is connected to the image forming device based on a detection result of the connection detecting portion.

11 Claims, 5 Drawing Sheets

IMAGE FORMING APPARATUS

BACKGROUND OF THE INVENTION

Field of the Invention

The present invention relates to an image forming apparatus including a plurality of AC receiving portions configured to receive power from an AC power source.

Description of the Related Art

In recent years, there have been demands in the market for a production printer, a multifunction peripheral, or another type of image forming apparatus adapted to use various kinds of recording sheets. Heat of a fixing unit is liable to be lost at the time of sheet passage depending on the thickness of the recording sheet, and it takes time to restore the temperature to that for fixing the next recording sheet, resulting in reduced productivity. In view of the above, there has been adopted a configuration in which a voltage of an AC power source is increased, and the number of power supplies to be supplied to the fixing heater is increased, to thereby shorten the temperature restoring time period. Further, there has been proposed an image forming apparatus including a power supply voltage determination device configured to distinguish, with high accuracy, voltage values of commercial power sources, which vary depending on foreign regions (Japanese Patent Application Laid-Open No. 2008-026175).

For example, an outlet for a general household in Japan has a power rating of 100 V and 15 A (1.5 kW), and a power cable therefor is widely distributed. As other power ratings, although electric work is required, single-phase 200 V and three-phase 200 V are also selectable. A power cable for 200 V can supply power up to 30 A (6 kW) depending on the type. However, as compared to a power cable for a general household, the power cable for 200 V has higher rated output and thus has a thicker cable diameter. The power cable for 200 V is also expensive because the cable has a less-distributed plug shape.

In view of the above, it is desired to supply power to the image forming apparatus through use of a plurality of inexpensive power cables for a general household without using the expensive power cable for 200 V. In this case, power can be supplied to a fixing device via an image forming device. However, when a supply unit configured to supply power from the image forming device to the fixing device is not appropriately connected, fixing of a toner image to the recording sheet by the fixing device may not be appropriately performed.

SUMMARY OF THE INVENTION

According to an embodiment of the present invention, there is provided an image forming apparatus, comprising: an image forming device including an image forming unit configured to form a toner image on a recording sheet; a fixing device including a fixing unit configured to fix the toner image to the recording sheet conveyed from the image forming device; a first AC receiving portion configured to receive power to be supplied from an AC power source to the image forming device via a first power cable; a second AC receiving portion configured to receive power to be supplied from the AC power source to the fixing unit via a second power cable; a third AC receiving portion, which is removably connected to the image forming device, and is configured to receive power to be supplied to the fixing unit via the first AC receiving portion; and a connection detecting portion configured to detect whether power is supplied from the third AC receiving portion to the fixing device, wherein the connection detecting portion is supplied with a voltage for an operation based on the power received from the AC power source via the second AC receiving portion, and wherein the image forming device detects whether the third AC receiving portion is connected to the image forming device based on a detection result of the connection detecting portion.

Further features of the present invention will become apparent from the following description of exemplary embodiments with reference to the attached drawings.

DESCRIPTION OF THE EMBODIMENTS

Figure 1:
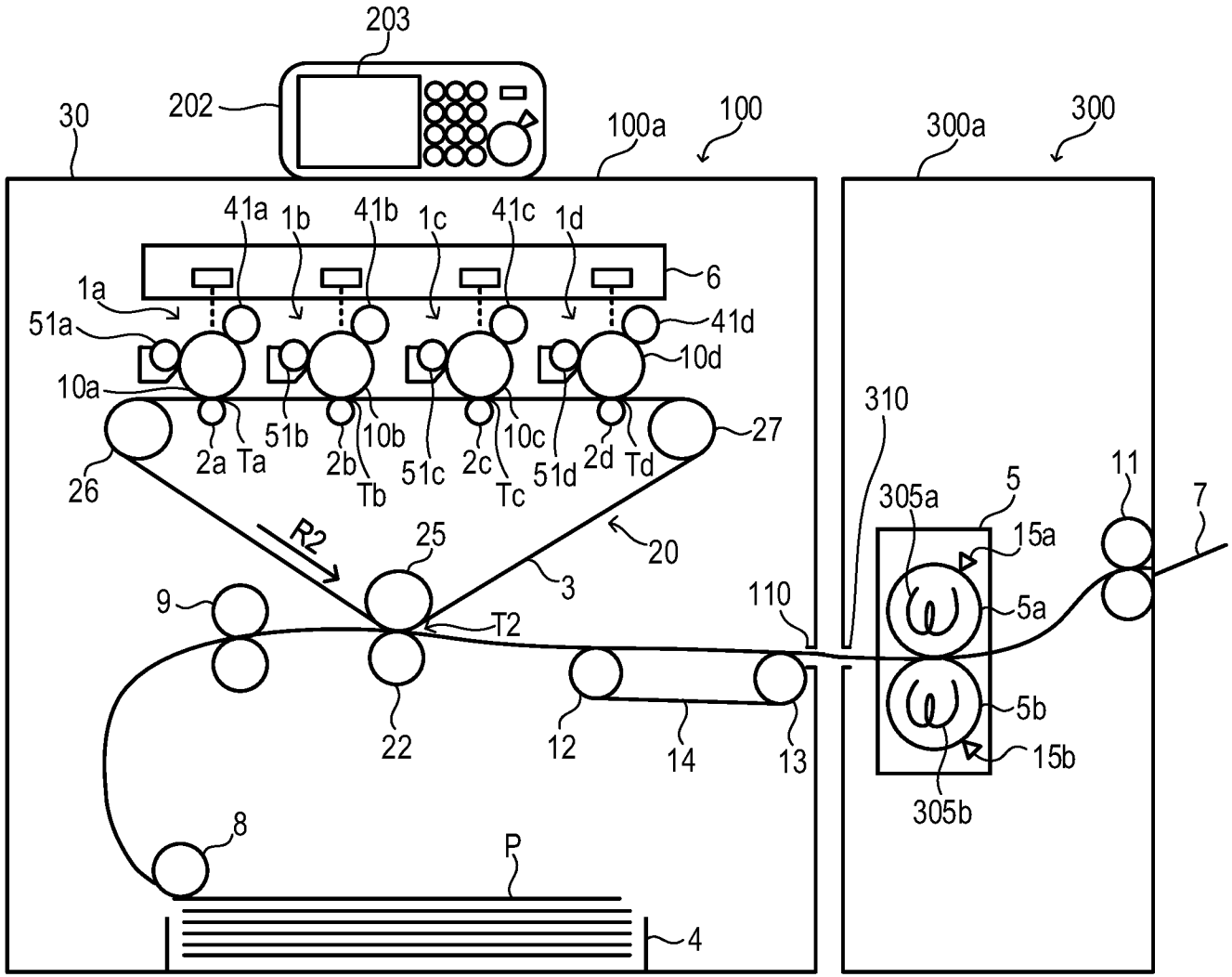
FIG. 1 is a diagram for illustrating an image forming apparatus and a fixing apparatus.

FIG. 1 is a diagram for illustrating an image forming apparatus 100 and a fixing apparatus 300. As illustrated in FIG. 1, the image forming apparatus 100 serving as an image forming device forms a toner image on a recording sheet P by a tandem-type intermediate transfer system in which image forming units 1*a*, 1*b*, 1*c*, and 1*d* are arranged along an upper surface of an intermediate transfer belt 3. The recording sheet P having the toner image formed thereon is conveyed to the fixing apparatus 300 serving as a fixing device. The fixing apparatus 300 fixes the toner image to the recording sheet P. In this manner, the image forming apparatus 100 and the fixing apparatus 300 form a full-color printer configured to form a full-color image on the recording sheet P.

Figure 5:
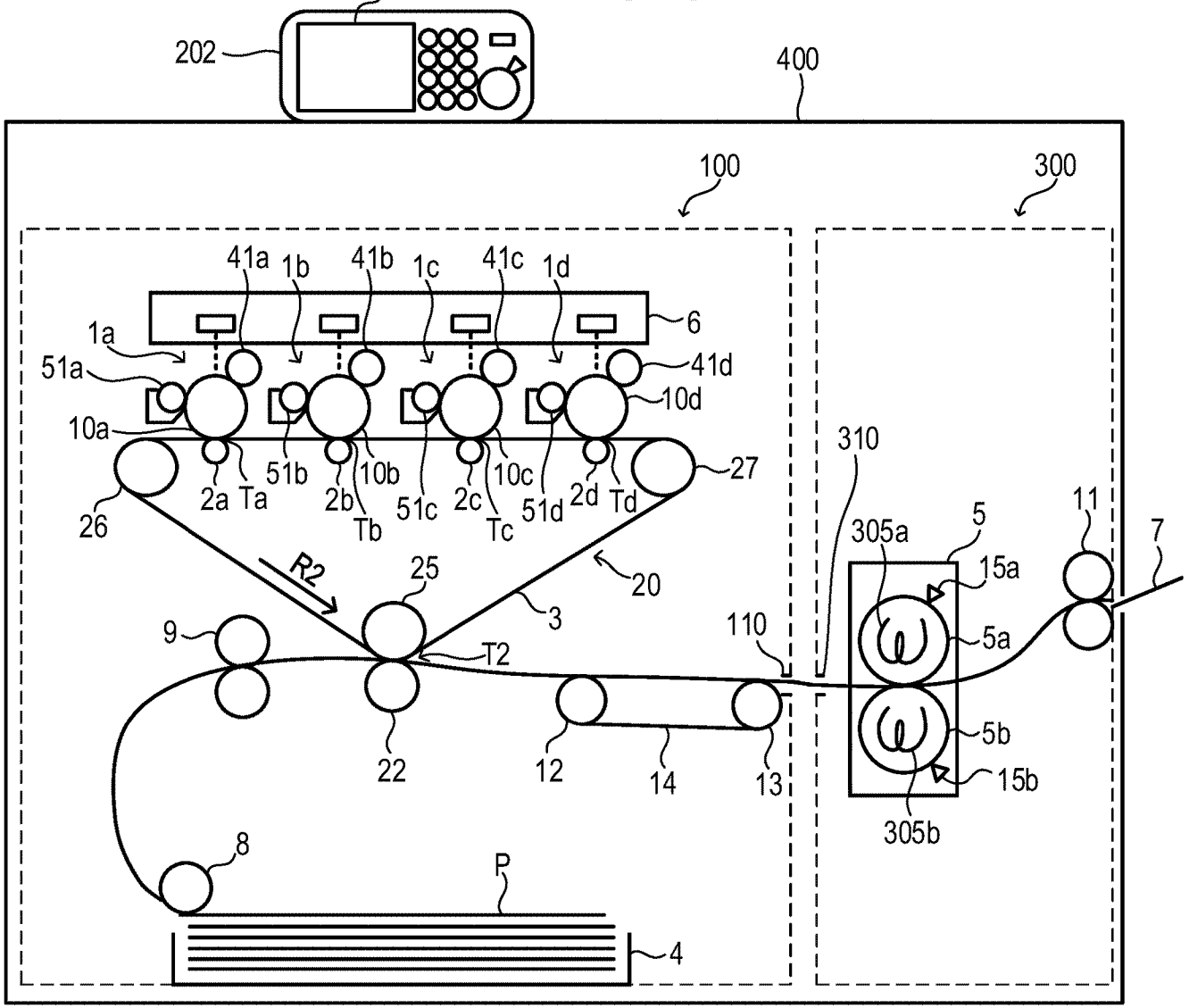
FIG. 5 is a diagram for illustrating one housing including the image forming apparatus and the fixing apparatus.

The fixing apparatus 300 is housed in a housing 300*a* different and independent from a housing 100*a* of the image forming apparatus 100. The fixing apparatus 300 is connected to the image forming apparatus 100 so as to be separable from the image forming apparatus 100. However, the fixing apparatus 300 may be formed together with the image forming apparatus 100 in one housing 400 (FIG. 5). FIG. 5 is a diagram for illustrating one housing 400 including the image forming apparatus 100 and the fixing apparatus 300. A combination of the image forming apparatus 100 and the fixing apparatus 300 is also referred to as "image forming apparatus".

A feeding cassette 4 configured to receive the recording sheets P is provided at a lower portion of the image forming apparatus 100. The feeding cassette 4 can be pulled out from a main body 30 of the image forming apparatus 100. A user pulls out the feeding cassette 4 from the main body 30 to replenish the recording sheets P into the feeding cassette 4, and pushes the feeding cassette 4 into the main body 30 again to mount the feeding cassette 4. A separation roller 8 separates the recording sheets P fed from the feeding cassette 4 from each other to convey each recording sheet P to registration rollers 9. A leading edge of the recording sheet P abuts against the stopped registration rollers 9, and thus the recording sheet P briefly waits at the registration rollers 9. The registration rollers 9 convey the recording sheet P to a secondary transfer portion T2 so that a leading edge of a toner image formed on the intermediate transfer belt 3 matches the leading edge of the recording sheet P.

The image forming units 1*a*, 1*b*, 1*c*, and 1*d* have substantially the same structure except that developing devices 51*a*, 51*b*, 51*c*, and 51*d* of the respective image forming units 1*a*, 1*b*, 1*c*, and 1*d* use toner of different colors. The image forming unit 1*a* forms a black toner image. The image forming unit 1*b* forms a cyan toner image. The image forming unit 1*c* forms a magenta toner image. The image forming unit 1*d* forms a yellow toner image. In the following, the image forming unit 1*a* is described, and description of the image forming units 1*b*, 1*c*, and 1*d* is omitted. Unless particularly required, suffixes "a", "b", "c", and "d" of the reference symbols are omitted.

The image forming unit 1 is configured as a replaceable unit integrally including a photosensitive drum 10, a charging device 41, and the developing device 51. The photosensitive drum 10 includes a photosensitive layer having a negative charging polarity on an outer peripheral surface of an aluminum cylinder. A drive force is transmitted from a drive motor (not shown) to the photosensitive drum 10 so that the photosensitive drum 10 rotates at a predetermined rotation speed (process speed). The charging device 41 charges the surface of the photosensitive drum 10 to a uniform negative potential.

An exposure device 6 scans, by a rotary mirror of each color, a laser beam that is ON/OFF modulated based on scanning line image data obtained by loading an image of each color of yellow, magenta, cyan, and black to thereby form an electrostatic latent image on the uniformly-charged surface of the photosensitive drum 10 of the corresponding color. The developing device 51 causes toner of each color to adhere to the electrostatic latent image formed on the surface of the photosensitive drum 10 of each color to form the toner image of each color.

A primary transfer roller 2 presses the intermediate transfer belt 3 toward the photosensitive drum 10 to form a primary transfer portion T between the photosensitive drum 10 and the intermediate transfer belt 3. When a positive DC voltage is applied to the primary transfer roller 2, the negative toner image borne on the surface of the photosensitive drum 10 is transferred onto the intermediate transfer belt 3 passing through the primary transfer portion T.

An intermediate transfer unit 20 is arranged below the image forming unit 1, and includes a support mechanism and a drive mechanism for the intermediate transfer belt 3. The intermediate transfer belt 3 is looped around and supported by a tension roller 27, a belt drive roller 26, and a secondary transfer inner roller 25, to thereby be driven by the belt drive roller 26 to rotate in an arrow R2 direction. The intermediate transfer belt 3 is an endless belt member configured not to extend or contract.

Primary transfer rollers 2*a*, 2*b*, 2*c*, and 2*d* are provided so as to correspond to the image forming units 1*a*, 1*b*, 1*c*, and 1*d*, respectively. The primary transfer rollers 2*a*, 2*b*, 2*c*, and 2*d* are biased by springs toward the photosensitive drums 10*a*, 10*b*, 10*c*, and 10*d*, respectively, so that the intermediate transfer belt 3 abuts against the photosensitive drums 10*a*, 10*b*, 10*c*, and 10*d*. Thus, the primary transfer portion T for primarily transferring the toner image is formed.

A secondary transfer outer roller 22 abuts against the intermediate transfer belt 3 whose inner side surface is stretched by the secondary transfer inner roller 25, to thereby form the secondary transfer portion T2 between an outer side surface of the intermediate transfer belt 3 and the secondary transfer outer roller 22. The secondary transfer inner roller 25 is provided in the intermediate transfer unit 20. Meanwhile, the secondary transfer outer roller 22 is provided in the main body 30 of the image forming apparatus 100. The secondary transfer inner roller 25 stretches the intermediate transfer belt 3 at the secondary transfer portion T2 for secondarily transferring the toner image. When a positive DC voltage is applied to the secondary transfer outer roller 22 from a power source (not shown), an electric field for transferring the toner image is formed between the secondary transfer outer roller 22 and the secondary transfer inner roller 25 connected to a ground potential.

The recording sheet P having the toner image formed thereon is discharged through a discharge port 110 of the image forming apparatus 100 by a discharge belt 14 looped around and supported by discharge rollers 12 and 13. The recording sheet P discharged through the discharge port 110 is received by a receiving port 310 of the fixing apparatus 300. The discharge port 110 of the image forming apparatus 100 is communicated with the receiving port 310 of the fixing apparatus 300 so as to be separable therefrom. The fixing apparatus 300 includes a fixing unit 5. The fixing unit 5 includes a fixing roller 5*a* and a pressure roller 5*b*. The pressure roller 5*b* is pressurized to the fixing roller 5*a* to form a heating nip between the fixing roller 5*a* and the pressure roller 5*b*. The fixing roller 5*a* and the pressure roller 5*b* include a fixing heater (first heating portion) 305*a* and a fixing heater (second heating portion) 305*b*, respectively. In a process of conveying the recording sheet P while nipping the recording sheet P by the heating nip, the recording sheet P is heated and pressurized so that the toner image is melted, and thus a full-color image is fixed to the surface of the recording sheet P. The fixing roller 5*a* and the pressure roller 5*b* have a thermistor 15*a* and a thermistor 15*b*, respectively, provided thereon to measure the temperatures of the fixing heaters 305*a* and 305*b*.

The recording sheet P having the full-color image fixed thereon is discharged from the fixing apparatus 300 by discharge rollers 11 to be stacked on a discharge tray 7. A post-processing apparatus may be connected in place of the discharge tray 7. The image forming apparatus 100 includes a user interface (hereinafter referred to as "console portion") 202 including an input/output interface. The user can operate the console portion 202 to give an instruction to perform a print operation as described above. The console portion 202 includes a display unit 203 configured to display indications to be shown to the user, such as states of the image forming apparatus 100 and the fixing apparatus 300, information on, for example, the number of sheets to be subjected to image formation and whether or not the image formation is in progress, and occurrence of jamming and the location thereof. Further, the display unit 203 displays, to a serviceman, an indication of a cause of an operation failure for improving the efficiency of service work, and a guide indication of an initialization operation at the time of installation of the main body or replacement of the developing device, and receives the start of an operation.

Figure 2:
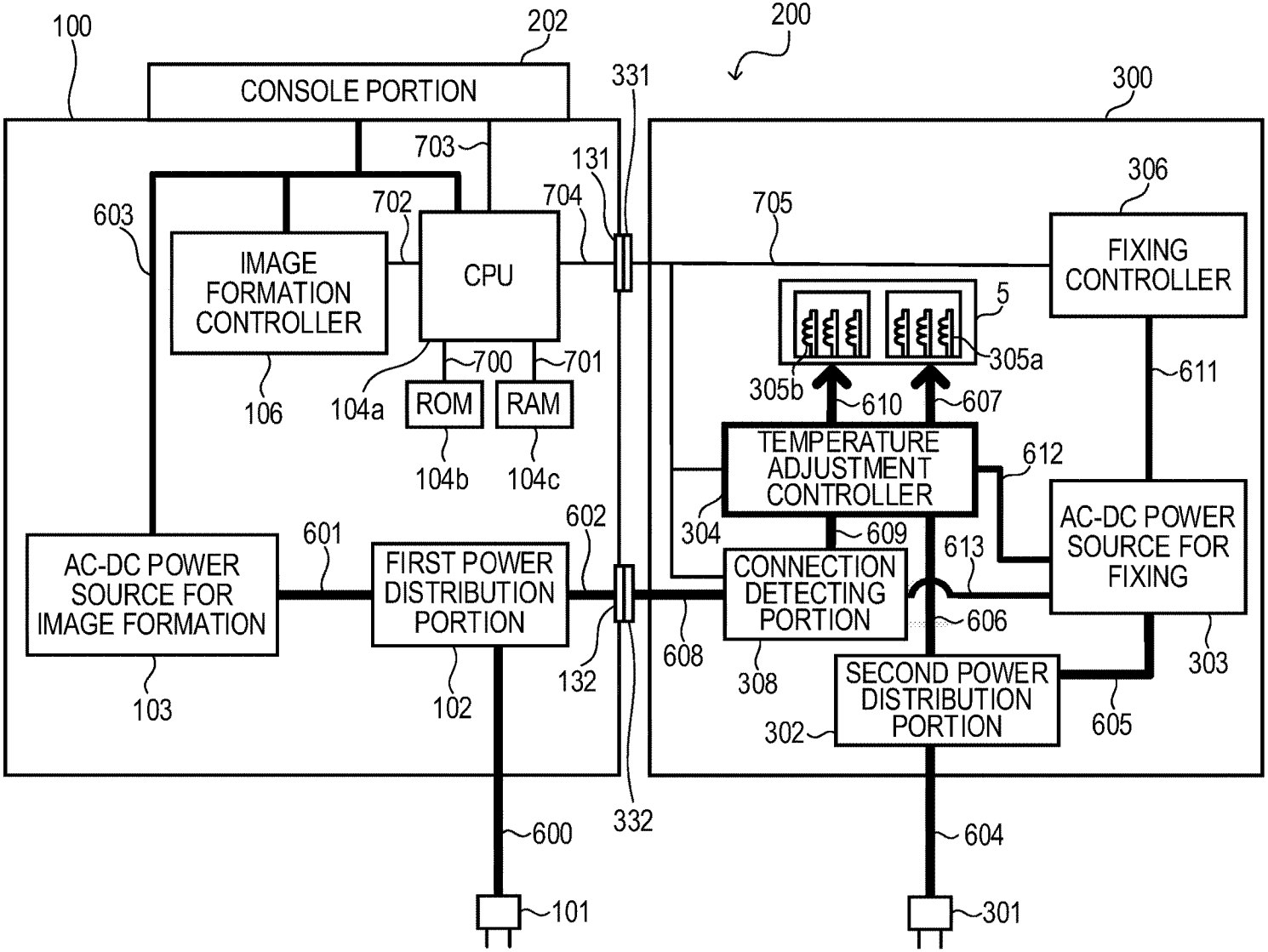
FIG. 2 is a block diagram for illustrating a control unit for the image forming apparatus and the fixing apparatus.

FIG. 2 is a block diagram for illustrating a control unit 200 for the image forming apparatus 100 and the fixing apparatus 300. In FIG. 2, power lines 600 to 602, 604 to 607, 609, and 610 serving as AC power supply lines are indicated by the thickest lines. Power lines 603 and 611 to 613 serving as DC power supply lines are indicated by lines thinner than the AC power supply lines. Signal lines 700 to 705 serving as communication control lines of a CPU 104*a* are indicated by the thinnest lines.

First, connection of the power lines 600, 601, 602, and 603 of the image forming apparatus 100 is described. Power is supplied to the image forming apparatus 100 from a commercial power source or other alternating-current power sources (AC power sources) through a power plug (hereinafter referred to as "first AC receiving portion") 101 and the power line 600 serving as a first power cable. In FIG. 2, for the sake of easiness in description, one power line 600 is provided to the image forming apparatus 100. However, the number of power cables of the image forming apparatus 100 is not limited to one. A plurality of power cables may be provided to the image forming apparatus 100.

The power from the AC power source received via the first AC receiving portion 101 is supplied to a first power distribution portion 102 through the power line 600. The power is supplied from the first power distribution portion 102 to an AC-DC power source 103 for image formation (first power source unit) through the power line 601. Further, the power is supplied from the first power distribution portion 102 to a relay connector 132 through the power line 602. The relay connector 132 of the image forming apparatus 100 is removably connected to a connector (hereinafter referred to as "third AC receiving portion") 332 of the fixing apparatus 300. The power from the AC power source is supplied from the third AC receiving portion 332 to the inside of the fixing apparatus 300 via the relay connector 132.

The AC-DC power source 103 for image formation converts an alternating-current voltage (AC voltage) into a direct-current voltage (DC voltage) to generate the DC voltage. The AC-DC power source 103 for image formation supplies power from a DC power source to an image formation controller 106, the CPU 104*a*, and the console portion 202 through the power line 603. The image formation controller 106 and the CPU 104*a* form a first controller. The power from the DC power source is supplied to each load (not shown) and sensors (not shown) via the image formation controller 106.

Next, connection of the power lines 604 to 613 of the fixing apparatus 300 is described. Power is supplied to the fixing apparatus 300 from a commercial power source or other alternating-current power sources (AC power sources) through a power plug (hereinafter referred to as "second AC receiving portion") 301 and the power line 604 serving as a second power cable. In FIG. 2, for the sake of easiness in description, one power line 604 is provided to the fixing apparatus 300. However, the number of power cables of the fixing apparatus 300 is not limited to one. A plurality of power cables may be provided to the fixing apparatus 300.

The power from the AC power source received from the second AC receiving portion 301 is supplied to a second power distribution portion 302 through the power line 604. The power from the second AC receiving portion 301 is supplied from the second power distribution portion 302 to an AC-DC power source 303 for fixing (second power source unit) through the power line 605. The power from the AC power source received from the second AC receiving portion 301 is supplied from the second power distribution portion 302 to a temperature adjustment controller 304 through the power line 606. The power from the second AC receiving portion 301 is supplied from the temperature adjustment controller 304 to the fixing heater 305*a* through the power line 607. The fixing heater 305*a* is built into the fixing roller 5*a* of the fixing unit 5 illustrated in FIG. 1.

The third AC receiving portion 332 is electrically connected to a connection detecting portion 308 by the power line 608. The power from the AC power source received from the third AC receiving portion 332 is supplied to the connection detecting portion 308 through the power line 608. The power from the third AC receiving portion 332 is supplied from the connection detecting portion 308 to the temperature adjustment controller 304 through the power line 609. The power from the third AC receiving portion 332 is supplied from the temperature adjustment controller 304 to the fixing heater 305*b* through the power line 610. The fixing heater 305*b* is built into the pressure roller 5*b* of the fixing unit 5 illustrated in FIG. 1.

The connection detecting portion 308 detects whether or not the third AC receiving portion 332 is connected to the relay connector 132 of the image forming apparatus 100. The connection detecting portion 308 is only required to have a configuration capable of detecting that the power from the AC power source is supplied from the third AC receiving portion 332, as in zero-cross detection of the AC voltage. A connection detection method of detecting whether or not the third AC receiving portion 332 is connected to the relay connector 132 is not limited the above-mentioned method, and other connection detection methods may be used.

The temperature adjustment controller 304 includes a mechanism (switch mechanism) for supplying and blocking the power from the AC power source, for example, a triac. The temperature adjustment controller 304 performs temperature adjustment control of controlling a period of supplying the power from the AC power source so that the fixing heaters 305*a* and 305*b* are brought to appropriate temperatures. In the embodiment, in addition to the fixing heater 305*a* of the fixing roller 5*a*, the fixing heater 305*b* is provided to the pressure roller 5*b*. Through use of the fixing heaters 305*a* and 305*b*, a rising time period of the fixing temperature is shortened, and abrupt temperature drop at the time of sheet passage is suppressed.

The AC-DC power source 303 for fixing converts an alternating-current voltage (AC voltage) into a direct-current voltage (DC voltage). The AC-DC power source 303 for fixing supplies power from a DC power source to a fixing controller (second controller) 306 though the power line 611. The power from the DC power source is further supplied to each load (not shown) and sensors (not shown) via the fixing controller 306. The AC-DC power source 303 for fixing supplies the power from the DC power source to the temperature adjustment controller 304 through the power line 612. The power from the DC power source supplied to the temperature adjustment controller 304 is used as power for temperature adjustment control. The AC-DC power source 303 for fixing supplies the power from the DC power source to the connection detecting portion 308 through the power line 613. The power from the DC power source supplied to the connection detecting portion 308 is used as power for connection detection.

Next, connection of the signal lines 700 to 705 of the CPU 104*a* is described. The CPU 104*a* integrally controls the image forming apparatus 100 and the fixing apparatus 300. The CPU 104*a* is connected to a ROM (memory unit) 104*b* so as to allow communication thereto or therefrom by the signal line 700. The CPU 104*a* is connected to a RAM (memory unit) 104*c* so as to allow communication thereto or therefrom by the signal line 701. The CPU 104*a* executes various sequences related to an image formation sequence determined in advance, in accordance with a program stored in the ROM 104*b*. At this time, the CPU 104*a* stores required data into the RAM 104*c*. The RAM 104*c* stores, for example, a setting value of a high voltage to be applied at the time of image formation, various kinds of data, and image formation instruction information from the console portion 202. The RAM 104*c* is supplied with power from a battery (not shown) to store data even when the image forming apparatus 100 is powered off.

The CPU 104*a* is connected to the image formation controller 106 so as to allow communication thereto or therefrom by the signal line 702. The CPU 104*a* performs drive of each load (for example, motor, solenoid, or clutch) of the image forming apparatus 100, acquisition of information from the sensors, and image formation control (for example, high-voltage output control or drum drive control) via the image formation controller 106. Further, the CPU 104*a* is connected to the console portion 202 so as to allow communication thereto or therefrom by the signal line 703.

The CPU 104*a* is connected to a relay connector 131 by the signal line 704. The relay connector 131 is connected to a connector 331 connected to the signal line 705 of the fixing apparatus 300. The CPU 104*a* performs communication to/from the fixing apparatus 300 via the signal line 704, the relay connector 131, the connector 331, and the signal line 705. Further, the connector 331 is connected to the fixing controller 306, the temperature adjustment controller 304, and the connection detecting portion 308, which are provided in the fixing apparatus 300, via the signal line 705.

The CPU 104*a* performs drive of each load in the fixing apparatus 300 and acquisition of information from the sensors via the fixing controller 306. The CPU 104*a* controls the switch mechanism of the temperature adjustment controller 304 to control the power from the AC power source to be supplied to the fixing heaters 305*a* and 305*b* so that the fixing roller 5*a* and the pressure roller 5*b* are brought to target temperatures. The CPU 104*a* controls the temperature adjustment controller 304 based on temperature information of the thermistor 15*a* and the thermistor 15*b* (FIG. 1) provided to the fixing roller 5*a* and the pressure roller 5*b*, respectively, to thereby maintain the temperatures of the fixing roller 5*a* and the pressure roller 5*b* at target temperatures. The CPU 104*a* acquires a detection state of the connection detecting portion 308 configured to perform connection detection between the third AC receiving portion 332 and the relay connector 132.

In the embodiment, a total value of power consumption of the image forming apparatus 100 and power consumption of the fixing apparatus 300 is set within a range of a total value of a rated voltage of the power line 600 of the first AC receiving portion 101 and a rated voltage of the power line 604 of the second AC receiving portion 301. Almost all power consumed by the fixing apparatus 300 is consumed by the fixing heater 305*a*. The power from the first AC receiving portion 101 is supplied via the image forming apparatus 100 to one fixing heater 305*b* of the plurality of fixing heaters 305*a* and 305*b* provided in the fixing apparatus 300. In this manner, each of the power consumption of the image forming apparatus 100 and the power consumption of the fixing apparatus 300 can fall within a range of rated power consumption of an outlet for a general household.

The fixing apparatus 300 is supplied with power from the image forming apparatus 100 via the third AC receiving portion 332. The image forming operation is executed under a state in which the relay connector 131 is connected to the connector 331 and further the relay connector 132 is connected to the third AC receiving portion 332. In a case where the connector 331 is not connected to the relay connector 131, the CPU 104*a* cannot communicate to/from the fixing apparatus 300. Thus, the CPU 104*a* displays an error on the display unit 203 of the console portion 202 to urge the user or the serviceman to connect the connector 331.

The third AC receiving portion 332 is connected to the connection detecting portion 308 via the power line 608. The connection detecting portion 308 detects whether or not the third AC receiving portion 332 is connected to the relay connector 132, and transmits a detection result to the CPU 104*a* via the signal line 705. The CPU 104*a* can instantly detect the connection state between the relay connector 132 and the third AC receiving portion 332 based on the detection result of the connection detecting portion 308. In a case where the third AC receiving portion 332 is not connected to the relay connector 132, the CPU 104*a* receives a low-level signal from the connection detecting portion 308. The CPU 104*a* displays an error on the display unit 203 of the console portion 202 to urge the user or the serviceman to connect the third AC receiving portion 332.

Even when the fixing heater 305*b* is not heated, temperature adjustment control to a temperature that allows fixing is possible through use of the fixing heater 305*a* alone. However, there is a fear in that the temperature drop at the time when a sheet passes through the fixing apparatus may not be able to be suppressed, and the image quality may be reduced. In a case where the temperature drop occurs at the time of sheet passage, the fixing performance reduces from the middle of the successive printing, but it is difficult to detect the reduction in image quality. A plurality of fixing heaters may be provided to the fixing apparatus 300 to suppress the temperature drop at the time of sheet passage, but the power consumption of the fixing apparatus 300 may exceed the rated power consumption. In the embodiment, power from the second AC receiving portion 301 of the fixing apparatus 300 is supplied to one fixing heater 305*a* of the plurality of fixing heaters 305*a* and 305*b* provided to the fixing apparatus 300. Power from the third AC receiving portion 332 is supplied to another fixing heater 305*b*. In this case, in a case where the third AC receiving portion 332 is not connected to the relay connector 132, power is not supplied to the fixing heater 305*b*. Thus, the CPU 104*a* is configured to allow detection of connection of the third AC receiving portion 332 through use of the connection detecting portion 308.

Figure 3:
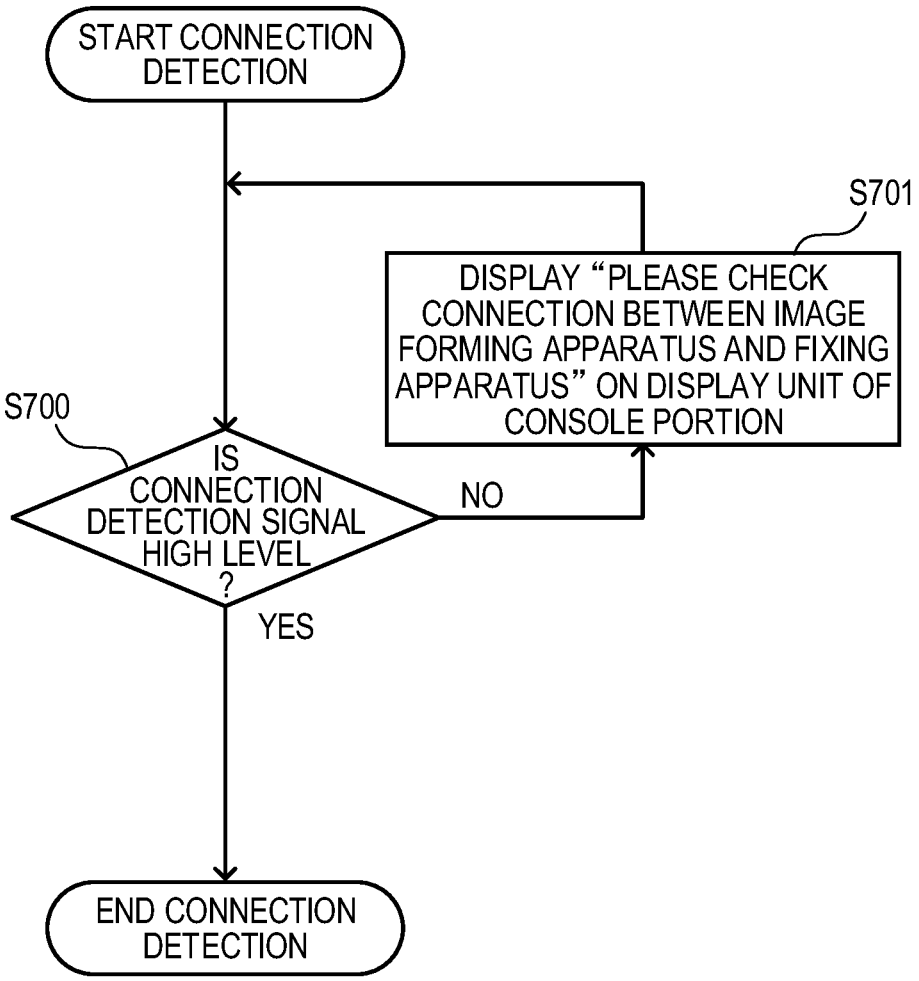
FIG. 3 is a flow chart for illustrating connection detection of a third AC receiving portion.

Next, with reference to FIG. 3, connection detection of the third AC receiving portion 332 to be executed by the CPU 104*a* is described. FIG. 3 is a flow chart for illustrating the connection detection of the third AC receiving portion 332. The CPU 104*a* executes the connection detection of the third AC receiving portion 332 in accordance with a program stored in the ROM 104*b*. In a case where the connection detection is started, the CPU 104*a* determines whether or not a high-level connection detection signal being a logic signal is output from the connection detecting portion 308 (Step S700).

In a case where the third AC receiving portion 332 is not connected to the relay connector 132, the connection detecting portion 308 outputs a low-level signal. In a case where the third AC receiving portion 332 is connected to the relay connector 132, the connection detecting portion 308 outputs a high-level signal. In a case where the connection detection signal is not high level (NO in Step S700), the CPU 104*a* displays, on the display unit 203 of the console portion 202, for example, a message of "please check connection between image forming apparatus and fixing apparatus" to urge the user or the serviceman to check the connection (Step S701). The CPU 104*a* displays the above-mentioned message on the display unit 203 and stands by while the connection detection signal from the connection detecting portion 308 is low level. When the user or the serviceman connects the third AC receiving portion 332 to the relay connector 132, the connection detection signal from the connection detecting portion 308 changes from low level to high level.

When the connection detection signal is high level (YES in Step S700), the CPU 104*a* ends the connection detection. In a case where the connector 331 is not connected to the relay connector 131, the CPU 104*a* cannot detect the connection detection signal from the connection detecting portion 308. In this case, similarly to the case in which the third AC receiving portion 332 is not connected to the relay connector 132, the CPU 104*a* detects that the connection detection signal is low level. Thus, the connection detection of the third AC receiving portion 332 involves connection detection of the connector 331.

Figure 4:
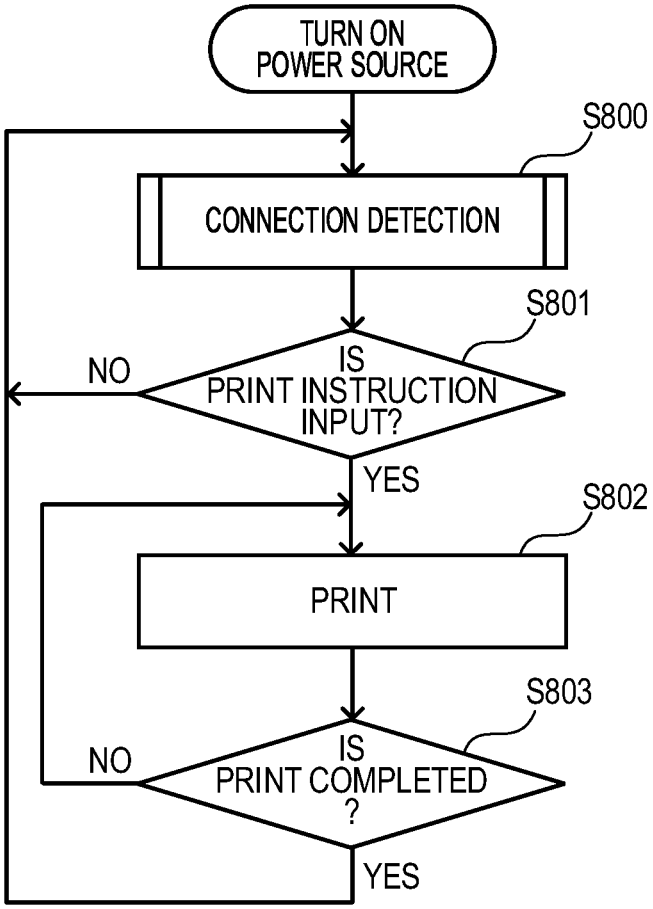
FIG. 4 is a flow chart for illustrating a print operation.

Next, with reference to FIG. 4, an operation performed after the power source is turned on is described. FIG. 4 is a flow chart for illustrating the operation performed after the power source is turned on. The CPU 104*a* executes the print operation in accordance with the program stored in the ROM 104*b*. When the image forming apparatus 100 is powered on, the CPU 104*a* is supplied with power and activated by the AC-DC power source 103 for image formation. The CPU 104*a* executes the connection detection illustrated in FIG. 3 at the time of activation (Step S800). The CPU 104*a* determines whether or not the print instruction is input (Step S801). In a case where no print instruction is input (NO in Step S801), the connection detection of Step S800 is executed again.

In a case where the print instruction is input (YES in Step S801), the CPU 104*a* executes printing via the image formation controller 106, the fixing controller 306, and the temperature adjustment controller 304 (Step S802). In a case where the instructed printing is completed (YES in Step S803), the processing returns to Step S800.

In the embodiment, as illustrated in FIG. 4, the CPU 104*a* executes the connection detection at the time of power activation or in a case where the print instruction is waited for. However, the timing to perform the connection detection is not limited thereto. For example, the CPU 104*a* may execute the connection detection during the print operation. Conversely, the CPU 104*a* may not execute the connection detection during a period in which the print instruction is waited for after the connection detection is performed at the time of power activation. Further, the connection detection may be executed when a detection mechanism configured to detect mechanical connection between the image forming apparatus 100 and the fixing apparatus 300 detects a change from non-connection to connection between the image forming apparatus 100 and the fixing apparatus 300. Further, the connection between the image forming apparatus 100 and the fixing apparatus 300 may be determined by the CPU 104*a* based on communication establishment between the CPU 104*a* and the fixing controller 306 instead of detecting the mechanical connection between the image forming apparatus 100 and the fixing apparatus 300, and then the connection detection may be executed. In the embodiment, the fixing heater 305*a* and the fixing heater 305*b* are provided to the fixing roller 5*a* and the pressure roller 5*b*, respectively. However, the number of fixing heaters is not limited thereto. For example, a plurality of fixing heaters may be provided only to the fixing roller 5*a*. Alternatively, a plurality of fixing heaters may be provided to each of the fixing roller 5*a* and the pressure roller 5*b*.

Further, even when the image forming apparatus 100 and the fixing apparatus 300 are arranged in one housing 400, the relay connector 132 and the third AC receiving portion 332 are provided in the housing 400.

According to the embodiment, it is possible to detect whether or not the third AC receiving portion 332 configured to receive power from the AC power source supplied from the commercial power source to the fixing apparatus 300 via the image forming apparatus 100 is normally connected.

According to the embodiment, it is possible to detect whether or not connection is established so that power is normally supplied from the AC power source to the fixing device via a different power cable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-188406, filed Oct. 15, 2019, which is hereby incorporated by reference herein in its entirety.

What is claimed is:

1. An image forming apparatus, comprising:

an image forming device including an image forming unit configured to form a toner image on a recording sheet;

a fixing device including a fixing unit configured to fix the toner image on the recording sheet conveyed from the image forming device;

a first AC receiving portion configured to receive power to be supplied from an AC power source to the image forming device via a first power cable;

a second AC receiving portion configured to receive power to be supplied from the AC power source to the fixing unit via a second power cable;

a third AC receiving portion, which is removably connected to the image forming device, and is configured to receive power to be supplied to the fixing unit via the first AC receiving portion; and a connection detecting portion configured to detect whether power is supplied from the third AC receiving portion to the fixing device, wherein the connection detecting portion is supplied with a voltage for an operation based on the power received from the AC power source via the second AC receiving portion, and wherein the image forming device detects whether the third AC receiving portion is connected to the image forming device based on a detection result of the connection detecting portion.

2. The image forming apparatus according to claim 1, wherein the fixing device is formed in a housing different from a housing in which the image forming device is formed, and is connected to the image forming device so as to be separable from the image forming device.

3. The image forming apparatus according to claim 1, wherein the fixing unit includes:

a first heating portion to which the power is to be supplied from the AC power source via the second AC receiving portion; and a second heating portion to which the power is to be supplied from the AC power source via the third AC receiving portion.

4. The image forming apparatus according to claim 1, wherein the image forming device includes:

a first controller configured to control the image forming device;

a first power source unit configured to generate a DC voltage for the first controller from the power supplied from the AC power source via the first AC receiving portion; and a first power distribution portion configured to distribute, to the third AC receiving portion, the power supplied from the AC power source via the first AC receiving portion.

5. The image forming apparatus according to claim 4, further comprising a user interface, wherein the first controller is configured to cause the user interface to display an error in a case in which it is determined that the third AC receiving portion is not electrically connected to the first power distribution portion based on the detection result of the connection detecting portion.

6. The image forming apparatus according to claim 4, wherein the fixing device includes:

a second controller electrically connected to the first controller so as to be separable from the first controller and configured to control the fixing device;

a temperature adjustment controller configured to control a temperature of the fixing unit;

a second power distribution portion configured to distribute power to be supplied from the AC power source to the fixing unit via the second AC receiving portion; and a second power source unit configured to generate a DC voltage for operating the connection detecting portion, the second controller, and the temperature adjustment controller from the power distributed by the second power distribution portion.

7. The image forming apparatus according to claim 6, wherein the fixing unit includes:

a first heating portion to which the power is to be supplied from the AC power source via the second AC receiving portion; and a second heating portion to which the power is to be supplied from the AC power source via the third AC receiving portion, and wherein the first controller controls the temperature adjustment controller so as to control each of the power to be supplied to the first heating portion via the second AC receiving portion and the power to be supplied to the second heating portion via the third AC receiving portion.

8. The image forming apparatus according to claim 5, wherein the first controller causes the user interface to display an error in a case in which it is determined that the connection detecting portion is not electrically connected to the first controller.

9. The image forming apparatus according to claim 1, wherein the AC power source is a commercial power source.

10. The image forming apparatus according to claim 1, wherein the image forming device includes a discharge port configured to discharge the recording sheet, wherein the fixing device includes a receiving port configured to receive the recording sheet discharged from the image forming device, and wherein the receiving port is communicated with the discharge port so as to be separable from the discharge port.

11. The image forming apparatus according to claim 1, wherein the image forming device and the fixing device are formed in one housing.

* * * * *